United States Patent [19]

Gingras

[11] 4,226,451

[45] Oct. 7, 1980

[54] SAFETY LATCH

[76] Inventor: Hilaire Gingras, 475 Côte Joyeuse (P.O. Box 1328), St. Raymond, Portneuf County, Canada

[21] Appl. No.: 955,316

[22] Filed: Oct. 27, 1978

[51] Int. Cl.[2] ..... E05C 1/16

[52] U.S. Cl. ..... 292/169.21

[58] Field of Search ..... 292/336.3, 169.12, 169.14, 292/169.15, 169.18, 174, 166, DIG. 65, DIG. 37; 70/380

[56] References Cited

U.S. PATENT DOCUMENTS

| | | | |
|---|---|---|---|
| 179,185 | 6/1876 | Gallaher | 292/140 |
| 367,827 | 8/1887 | McIntyre | 292/140 |
| 1,169,659 | 1/1916 | Lowell | 292/142 |
| 1,968,285 | 7/1934 | Egan | 292/172 |
| 2,771,313 | 11/1956 | Blake | 292/142 |
| 2,904,855 | 9/1959 | Hagerty | 292/140 X |
| 3,193,315 | 7/1965 | James | 292/169.18 |
| 4,121,864 | 10/1978 | Kagoura | 292/336.3 X |

*Primary Examiner*—Richard E. Moore

[57] ABSTRACT

This latch is meant to provide safety against unintended actuation, in particular by a child, and is characterized by requiring a relatively unnatural combination of pushing and rotation to be actuated. More particularly, the rotation must be done while the knob or handle is held in pushed position against a spring bias. This safety latch includes a latch housing, a slidable bolt having a wedge shape outer end portion selectively retractable in the latch housing, a cam rotatably engaging the bolt and operatively retracting the latter, a stem extending endwise into the latch housing, axially pushable inward, and operatively rotating the cam for retraction of the bolt by the cam upon rotation of the stem while the latter is held inwardly pushed.

2 Claims, 9 Drawing Figures

SAFETY LATCH

This invention relates to a latch and, more particularly, to a latch of the type including a safety feature to prevent against unintended operation of a latch and opening of a door, drawer, or the like, such as for instance by a child.

So far, there have been proposed safety latches of the above type. In these previously proposed latches, the actuation or operation requires pulling and rotation of the handle or knob. This, obviously, provides some safety against unintended operation, since more than a mere rotation is required. However, it remains that pulling and rotation of a door handle, or knob, is a very natural operation, even by a child, and this combination of pulling and rotation is not very safe against undesired intrusion.

It is a general object of the present invention to provide a safety latch which is operated by a relatively unnatural combination of movements including pushing and rotation.

It is another general object of the present invention to provide a safety latch of the above type which provides relatively more safety against unintended operation or actuation and yet, which is of relatively simple and low cost construction.

It is a more specific object of the present invention to provide a safety latch of the above type, which is operated by a combination of a pushing movement and a rotation while the handle, or knob, is held in the pushed position against a spring bias.

The above and other objects and advantages of the present invention will be better understood with reference to the following detailed description of a preferred embodiment thereof which is illustrated, by way of example, in the accompanying drawings, in which.

Figures 1, 2, 3, 4, 5, 6:
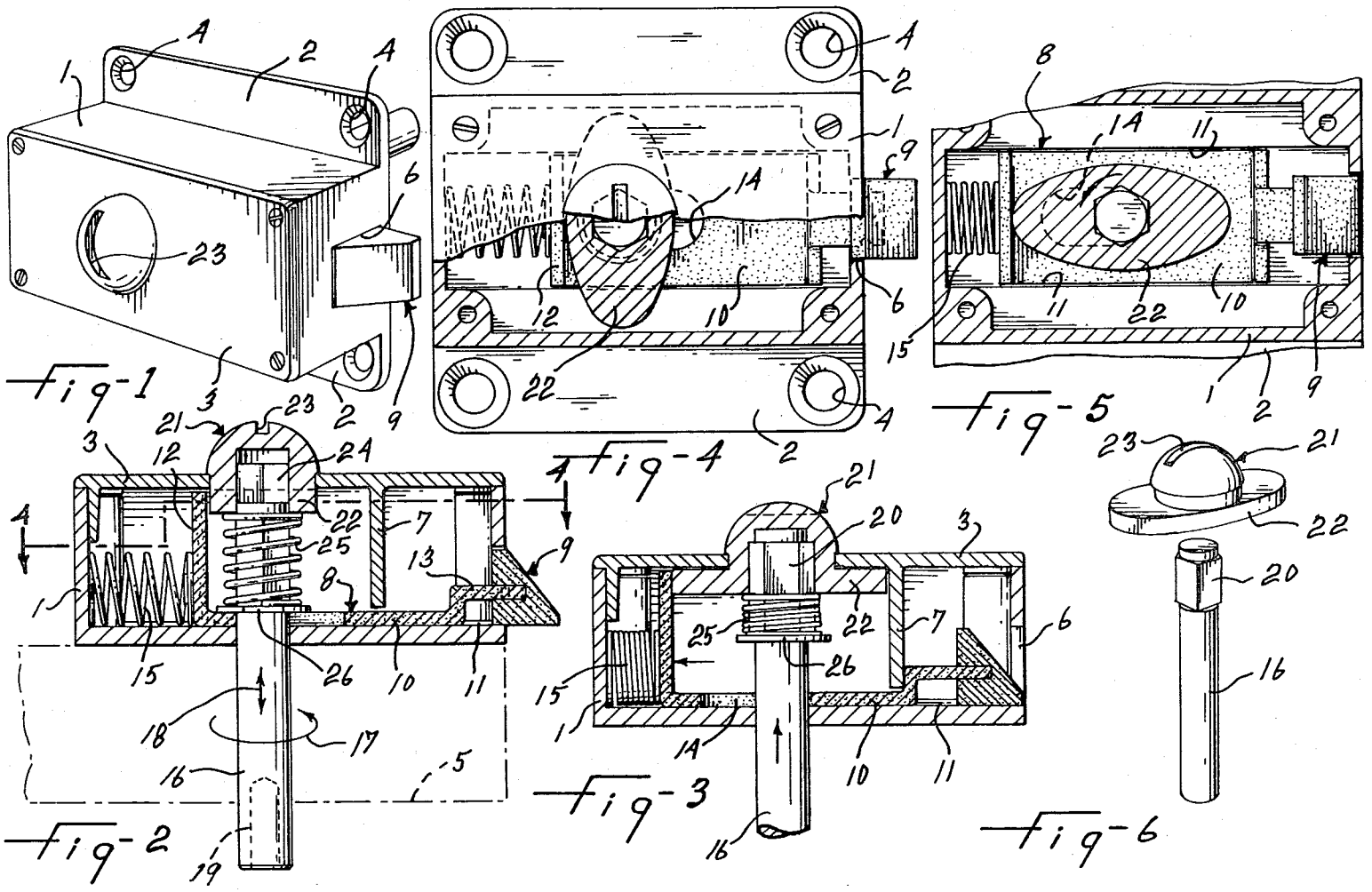
FIG. 1 is a perspective view of a safety latch according to the present invention.
FIG. 2 is a cross-section taken longitudinally of the latch of FIG. 1.
FIG. 3 is a cross-section as in FIG. 2 but with the bolt in retracted position.
FIG. 4 is a plan view of the safety latch with part in cross-section as seen along line 4—4 in FIG. 2.
FIG. 5 is a partial cross-sectional view as in FIG. 4 but with the bolt in retracted position as in FIG. 3.
FIG. 6 is an exploded perspectve view of a stem and cam members according to the embodiment of FIGS. 1 to 5 inclusive.
Figure 7:
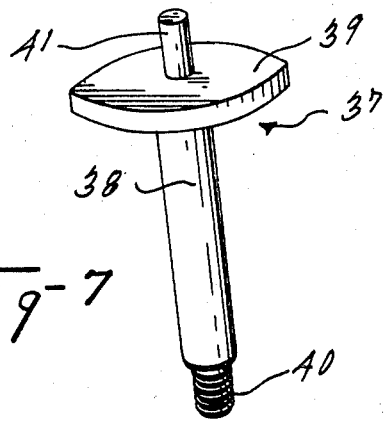
FIG. 7 is a perspectve view of a cam and stem according to a second embodiment of the present invention shown in FIGS. 8 and 9.
Figure 8:
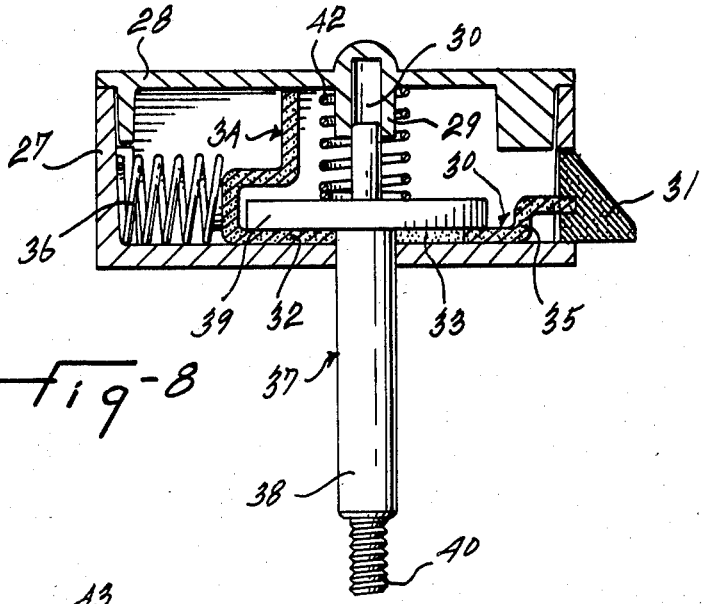
FIG. 8 is a longitudinal cross-section through a safety latch according to a second embodiment of the present invention.
Figure 9:
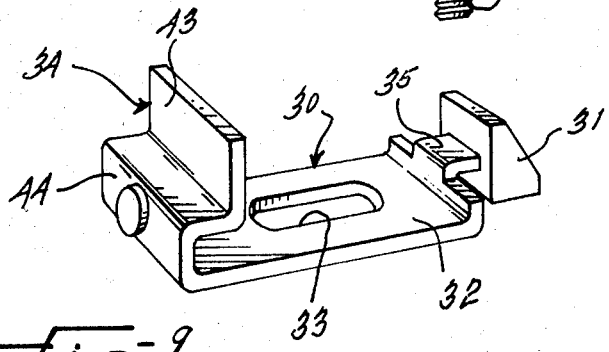
FIG. 9 is a perspective view of a bolt according to the present invention and used in the second embodiment illustrated in FIG. 8.

The safety latch, illustrated in FIGS. 1 to 6 inclusive, includes a housing 1, of generally rectangular outline, having a pair of flanges 2, and a cover plate 3. The flanges 2 project from the opposite sides of the housing 1, coplanar with the rear face of the housing, and are formed with holes 4 for screws to fix the latch against the internal face of an outwardly opening door 5, as shown in FIG. 2. The housing 1 is formed with an aperture 6 in one end thereof. The cover plate 3 is screwed on the front of the housing 1 and is formed with a projection 7 forming a transverse partition in this housing.

A bolt or bolt member is slidably mounted in the housing 1 and is formed of a main body 8 and a latching wedge 9. The main body 8 of the bolt includes a flat base portion 10 slidable flat against the internal face defined by the rear wall of the housing 1 in a guideway defined by a pair of laterally spaced-apart shoulders 11 formed by this rear wall. The main body 8 is formed with a rear abutment plate portion 12 extending transversely in the housing 1, and with a front tongue portion 13 forwardly of the transverse partition 7. The portions 12 and 13 are integrally formed with the flat base portion 10 at the opposite ends thereof, respectively. The flat base portion 10 is formed with a slot 14 extending lengthwise longitudinally thereof. The wedge 9 is fixedly secured to the tongue portion 13 for bodily displacement therewith and is slidable in and out through the aperture 6 in the end of the latch housing. As shown in FIG. 2, the oblique face of the wedge 9 faces away from the door 5, whereby, upon closing of the door, the bolt will be wedged inward to retract sufficiently to clear the door frame or jamb. A spring 15 is compressed between the closed end of the housing 1 and the abutment plate portion 12 and outwardly biases the bolt and the latching wedge 9.

A stem 16 extends endwise through the rear wall of the housing 1 and through the slot 14 in the flat base portion 10 of the bolt. The stem 16 is rotatable and slidable endwise, as indicated by the arrows 17 and 18, respectively. The external end of the stem 16 is formed with an internally screw-threaded bore 19 to screw a knob or handle thereto. The internal end of the stem is formed with a portion 20 having an hexagonal cross-section, or any other appropriate non-circular cross-section.

A bolt actuator member 21 is rotatably secured to the cover plate 3 in axial alignment with the stem 16. The bolt actuator member 21 includes an internal portion constituting a cam 22 having an ellipsoidal camming surface at the periphery thereof. The external portion of the bolt actuator member 21 forms a rounded head with a screwdriver slot 23 therein to be rotated by a screwdriver or some other similar edge. The bolt actuator member or device is formed with a cavity 24 extending axially therein from the internal end thereof. This cavity has the same cross-sectional shape as the end portion 20 of the stem to allow axial engagement of the stem therein and rotation by the latter. A spring 25 is engaged around the end portion 20 in abutment between a washer 26 and the cam 22 to outwardly bias the stem 16 relative to the housing 1 and also relative to the cavity 24. Thus, the spring 25 inoperatively holds the end portion 20 out of the cavity 24 to disable actuation of the bolt by mere rotation of the stem 16.

In this embodiment of FIGS. 1 to 6 inclusive, it may readily be seen that the bolt member 8-9 is actuated upon inward axial displacement to produce clutching engagement at the clutching interface between the bolt actuator 21 and the stem 16 and by thereafter rotating the cam 22, such that the longest axis thereof aligns with the longitudinal direction defined by the bolt.

In the second embodiment, the safety latch includes a housing 27, generally similar to the latch housing 1 and also including lateral flanges 2, not shown, and an aperture 6 in one end thereof. A cover plate 28 removably closed the front face of the housing 27. The cover plate 28 is formed with an internal projection 29 having a bore 30 therein.

A bolt member is slidably mounted in the housing 27 and includes a main body 30 and a latching wedge 31. The main body of the bolt member includes a flat base portion 32 constructed and arranged like the flat base portion 10 of the preceding embodiment and thus similarly including a slot 33 extending lengthwise longitudinally thereof. The main body 30 of the bolt member is also formed with a rear abutment plate portion 34 extending transversely in the housing 27, and with a front tongue portion 35. The portions 34 and 35 are integrally formed with the flat base portion 32 at the rear and front ends respectively thereof. The latching wedge 31 is fixedly secured to the front tongue portion 35 and operates in conventional manner, as briefly defined above in relation with wedge 9. A spring 36 is compressed between the closed end of the housing 27 and the abutment plate portion 34 and outwardly biases the bolt and the latching wedge 31.

A stem and bolt actuator member 37 is operatively connected to the housing 27 and includes a stem 38 and a cam 39. The stem 38 includes a larger external portion axially aligned with the bore 30 and displaceable endwise and rotatable relative to the housing 27. The outer end of the stem 38 is threaded at 40 to fix a handle, or knob, to the stem. The stem has an inner end portion 41, of smaller diameter, both axially and rotatably engageable in the bore 30.

The cam 39 is fixed to the stem 38 inside the housing 27 to bodily rotate and axially move with the stem. This cam 39 is of the same ellipsoidal configuration as the cam 22 of the other embodiment. A spring 42 is engaged around the boss 29 and the stem portion 41 to outwardly bias the stem 38 toward disengagement or declutching of the cam 39 relative to the rear abutment plate portion 34. It will be readily understood that the cam 39 is in clutching engagement when it is moved axially inward to engage the nearest portion 43 of the abutment portion 34 of the bolt. When the stem 38 is released, the spring 42 disables the cam 39 by pushing it outward to axial registry with the farthest portion 44 of the abutment portion 34.

It is seen in this case that, in addition to pushing and rotation as for the preceding embodiment, the stem must also be originally rotated to transversely align the cam 39 such that it can be pushed axially clear of the nearest portion 43.

These latches, as may be understood, are relatively safe against children, since it requires to hold the stem pushed axially inward while the cam is rotated to disengage the wedge 9 or 31. The children are not naturally inclined to produce such concerted actions.

In the second embodiment, the sharp ends of cam 39 can be rounded as cam 22 to decrease wear.

The threads of outer end 40 of stem 38 can be replaced by a flat to positively prevent rotation of the knob or handle relative to the stem.

The flat inclined face of the latching wedge 31 can be made somewhat convex to facilitate closing of the door.

What I claim is:

1. A safety latch comprising an elongated housing having means to secure said housing to a door, window and the like closure pivotally mounted in a frame with an end wall of said housing coinciding with an edge of said closure, a bolt member having a latching outer end portion extending through an aperture in said end wall, said bolt member slidably mounted in said housing for movement longitudinally thereof between a protruding latching position and a retracted unlatching position, first spring means in said housing biasing said bolt member towards latching position, said latching outer end portion having a bevelled outer end face oriented so that, by engaging said frame, it will cause retraction of said bolt member upon closing of said closure, said bolt member including a flat base portion slidable against the internal surface of one longitudinal wall of said housing, and having an elongated slot extending longitudinally of said housing, said bolt member including an abutment plate portion extending transversely of said housing and of said base portion and remote from said end wall relative to said elongated slot, said abutment plate portion including a first part adjacent said base portion and a second part spaced from said base portion transversely of said housing, said first part being more distant from said end wall than said second part, an operating stem protruding from and extending transversely of said housing through said one longitudinal wall of said housing and through said elongated slot and mounted for rotation and for axial movement relative to said housing, an ellipsoidal cam fixed to said stem at its center and located within said housing intermediate said end wall and said abutment plate portion, second spring means in said housing biasing said stem outwardly of said housing to a first axial position in which said cam registers with said first part of said abutment plate portion, said stem movable against the bias of said second spring means inwardly of said housing to a second axial position in which said cam registers with said second part of said abutment plate portion, said cam clearing said first part in all rotated positions of said stem and cam, said cam clearing said second part only in rotated positions of said stem and cam wherein the longer axis of said cam extends transversely of said housing, whereby rotation of said stem while in said second axial position causes said cam to engage said second part and retract said bolt member to unlatching position against the bias of said first spring means.

2. A safety latch as claimed in claim 1, wherein said stem has an inner end located within said housing and slidably rotatably mounted within a blind bore formed in a longitudinal wall of said housing remote from said one longitudinal wall.

* * * * *